US010107038B2

(12) United States Patent
Da Silva et al.

(10) Patent No.: US 10,107,038 B2
(45) Date of Patent: Oct. 23, 2018

(54) TURBINE DRILL BIT ASSEMBLY

(71) Applicant: Halliburton Energy Services, Inc., Houston, TX (US)

(72) Inventors: Nuno Da Silva, Brussels (BE); Olivier Dupont, Saint-Ghislain (BE)

(73) Assignee: Halliburton Energy Services, Inc., Houston, TX (US)

( * ) Notice: Subject to any disclaimer, the term of this patent is extended or adjusted under 35 U.S.C. 154(b) by 202 days.

(21) Appl. No.: 14/429,276

(22) PCT Filed: Sep. 18, 2012

(86) PCT No.: PCT/EP2012/068316

§ 371 (c)(1),
(2) Date: Mar. 18, 2015

(87) PCT Pub. No.: WO2014/044290

PCT Pub. Date: Mar. 27, 2014

(65) Prior Publication Data

US 2015/0247364 A1 Sep. 3, 2015

(51) Int. Cl.

| | |
|---|---|
| ***E21B 4/02*** | (2006.01) |
| ***E21B 17/10*** | (2006.01) |
| ***E21B 10/00*** | (2006.01) |

(52) U.S. Cl.

CPC ..... *E21B 4/02* (2013.01); *E21B 10/00* (2013.01); *E21B 17/1078* (2013.01); *E21B 17/1092* (2013.01)

(58) Field of Classification Search

CPC ..... E21B 4/02; E21B 10/00; E21B 17/1092; E21B 17/1078

See application file for complete search history.

(56) References Cited

U.S. PATENT DOCUMENTS

| | | | | |
|---|---|---|---|---|
| 4,465,147 | A * | 8/1984 | Feenstra | E21B 4/20 175/325.2 |
| 4,862,974 | A | 9/1989 | Warren et al. | |
| 2015/0247364 | A1 | 9/2015 | Da Silva et al. | |

FOREIGN PATENT DOCUMENTS

| | | |
|---|---|---|
| EP | 0109699 | 5/1984 |
| EP | 0109699 A2 | 5/1984 |

(Continued)

OTHER PUBLICATIONS

International Search Report and Written Opinion, Application No. PCT/EP2012/068316, 10 pages, dated Jun. 5, 2013.

(Continued)

*Primary Examiner* — D. Andrews
*Assistant Examiner* — Manuel C Portocarrero
(74) *Attorney, Agent, or Firm* — Baker Botts L.L.P.

(57) ABSTRACT

A turbine-drill bit assembly is disclosed. The assembly comprises a box connection turbine connected to a pin connection drill bit. The turbine has a turbine body around a turbine shaft, the turbine body having a turbine stabilizer. The drill bit has a bit gauge or a bit sleeve around a bit shank, an end of the turbine stabilizer nearest the drill bit being spaced a first maximum distance from an end of the bit gauge or bit sleeve. In addition, a shouldering interface is formed at respective abutment shouldering surfaces of the turbine shaft and bit shank when the drill bit is attached to the turbine shaft, the interface being spaced a second maximum distance from an end of the bit gauge or bit sleeve.

10 Claims, 4 Drawing Sheets

(56) References Cited

FOREIGN PATENT DOCUMENTS

| | | | |
|---|---|---|---|
| GB | 2468781 | | 9/2010 |
| GB | 2468781 | A | 9/2010 |
| GB | 2521304 | | 6/2015 |
| WO | 2012/051674 | A1 | 4/2012 |
| WO | 2014/044290 | | 3/2014 |

OTHER PUBLICATIONS

Office Action received for Canadian Patent Application No. 2885257; dated Apr. 11, 2016; 4 pages.
International Preliminary Report on Patentability for PCT Patent Application No. PCT/U S2013/058903; 11 pages, dated Nov. 22, 2013.
Office Action received for Canadian Patent Application No. 2885257, dated Feb. 3, 2017; 6 pages.

* cited by examiner

TURBINE DRILL BIT ASSEMBLY

RELATED APPLICATION

This application is a U.S. National Stage Application of International Application No. PCT/EP2012/068316 Sep. 18, 2012, which designates the United States, and which is incorporated herein by reference in its entirety.

FIELD OF THE INVENTION

The present invention relates to improvements in or relating to drilling apparatus, and is more particularly concerned with tandem turbine and drill bit arrangements.

BACKGROUND TO THE INVENTION

It is known to use down-hole turbines in drill strings in tandem with drill bits. A performance turbine is used in drilling operations to provide higher power and rotational speed to the drill bit. The turbine comprises a turbine body and a turbine shaft, the turbine shaft rotation being independent from the turbine body. The turbine body is connected to the drill string rotating at the drill string speed. The turbine stabiliser may be mounted on a turbine body surrounding the turbine shaft. The turbine body may comprise the turbine stabiliser. The turbine shaft is driven by mud flowing through the turbine and rotates at a higher rotational speed independently of the drill string.

As described above, the performance turbine is connected to the drill string by the turbine body and to the drill bit by the turbine shaft. Mud pumped through the turbine increases the overall rotational speed of the turbine shaft and drill bit. Typically, drill strings strictly powered by rotary tables or top drives rotate at speeds between 50 and 200 rpm while performance turbines can rotate at speeds between 700 and 1800 rpm. This means that currently the available maximum rotational speed of a drill bit connected to the drill string by way of such a performance turbine is around 2000 rpm, that is, the sum of the rotational speed of the rotary table or top drive and the maximum rotational speed of the performance turbine.

In such tandem turbine-drill bit assemblies, the drill bit is connected to the turbine shaft of the performance turbine by means of through a threaded connection. Typically, such a threaded connection comprises a so-called "box" connector (or connection) or female threaded connection provided on the drill bit and a so-called "pin" connector (or connection) or male threaded connection provided on the turbine shaft lower end. Alternatively, the turbine shaft may have the "box" connector or connection and the drill bit may have the "pin" connector or connection. Such threaded connections are determined in accordance with American Petroleum Institute (API) standards.

In typical tandem turbine-drill bit assemblies, the drill bit tends to have a box API connector or connection for engaging with the turbine shaft having a pin API connector or connection. Breaker-slots are located in a suitable position along the gauge or length of the sleeve and extend into the shank. The breaker-slots are provided on the shank of the drill bit so that a tool, known as a bit breaker, can be inserted into the breaker-slots to provide relative rotation, in one direction, between the turbine shaft and the drill bit to make the connection forming the tandem assembly. Similarly, relative rotation in the opposite direction enables removal of the drill bit when it needs to be replaced, for example.

The drill bits used in these tandem assemblies tend typically to be box connection long gauge bits. The term "long gauge bit" refers to a drill bit having a drill head, a gauge, having a length of 125 mm (5") or longer, and usually with a sleeve having, typically, a length of 150 mm (6") or longer. The term "short gauge bit" refers to a drill bit having a drill head and a gauge which has a length that is less than 125 mm (5"), usually without a sleeve. As is well understood in the art, the term "drill bit" refers to a cutting head mounted on, or integrally formed with, the shank with or without a sleeve fixed on the shank. Typically, when a bit and turbine are assembled, a gap of between 125 mm to 250 mm (5" to 10") remains between the turbine stabiliser and the bit gauge end or the bit sleeve end.

As mentioned above, due to the types of connections provided on bit shanks and turbine shafts, when assembled in tandem, there may be a substantial gap between the turbine stabiliser and the gauge end or sleeve end of the bit. Such a gap allows rings of rock debris and mud resulting from the drilling operation, to form around the turbine shaft and bit shank thereby increasing wear and erosion of the bit shank and/or the turbine shaft. Another drawback of the gap results in a longer length of the turbine-drill bit assembly with reduced rigidity of the drill string. This longer length may also create an instability of the drill bit and vibrations that effectively reduce the drilling efficiency. This is particularly a problem in eccentric turbine-drill bit assemblies or in directional drilling.

By the term "eccentric" is meant that the bit does not have an effective rotational axis that is coincident with the longitudinal axis of the turbine body or drill string, and the effective rotational axis forms a circle around the drill string longitudinal axis. In these conditions, the well diameter drilled is larger than drill bit diameter.

SUMMARY OF THE INVENTION

It is therefore an object of the present invention to provide an improved tandem turbine-drill bit assembly that is more rigid and more stable and suffers from fewer vibrations allowing higher directional drilling performance.

It is a further object of the present invention to provide a tandem turbine-drill bit assembly which is less susceptible to wear and/or erosion due to the presence of rings of mud with high concentration of rock debris.

In accordance with one aspect of the present invention, there is provided a turbine-drill bit assembly comprising: a turbine having a turbine body and a turbine shaft; and a drill bit having at least a bit head, a bit gauge and a bit shank, the drill bit being connected to the turbine shaft at a shouldering interface; characterised in that the turbine body stabiliser is spaced from an end of the bit gauge by a first maximum distance and in that the shouldering interface is spaced from the end of the bit gauge by a second maximum distance, the first maximum distance being greater than the second maximum distance.

The term "turbine body stabiliser" as used herein is intended to refer to a turbine body having a turbine stabiliser formed thereon. Typically, the combination of a turbine body and a turbine stabiliser is known as a turbine body stabiliser. The turbine body stabiliser may be concentric or eccentric to the turbine body axis.

By reducing the gap between the turbine body stabiliser end and the bit gauge end or bit sleeve end, it is possible to reduce substantially the build-up of rock debris between and around the turbine shaft and the drill bit shank. This has the advantage that the overall performance of the turbine-drill bit assembly is improved.

The drill bit may include a bit sleeve which extends over the bit shank from the bit gauge, the turbine stabiliser being spaced from an end of the bit sleeve by the first maximum distance and the shouldering interface is spaced from the end of the bit sleeve by the second maximum distance.

In one embodiment, the turbine comprises a concentric turbine stabiliser in which the turbine body stabiliser has a rotation axis substantially aligned with an axis of the turbine shaft.

In another embodiment, the turbine comprises an eccentric turbine stabiliser in which the turbine body stabiliser has a rotation axis offset from an axis of the turbine shaft.

In one embodiment, the shouldering interface comprises a box connector on the turbine shaft connected to a pin connector on a bit shank.

Ideally, the first maximum distance is at most 50 mm and the second maximum distance is at most 25 mm.

A drill bit is also provided for use in the turbine-drill bit assembly described above, the drill bit comprising a bit head, a bit gauge and a bit shank, the bit shank including a pin connector. The drill bit may further comprise a bit sleeve extending between the bit gauge and the pin connector.

BRIEF DESCRIPTION OF THE DRAWINGS

For a better understanding of the present invention, reference will now be made, by way of example only, to the accompanying drawings in which.

DESCRIPTION OF THE INVENTION

Figure 2:
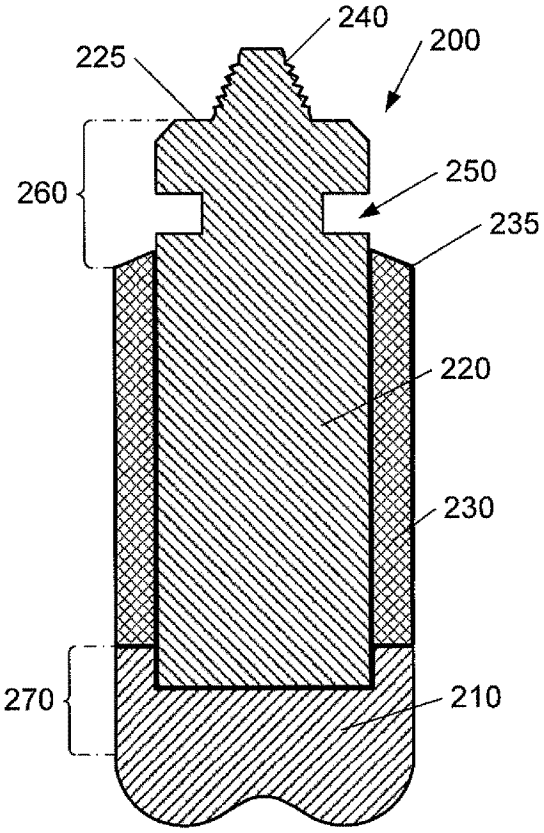
FIG. 2 illustrates a longitudinal cross-section through a conventional pin connection drill bit with sleeve.

The present invention will be described with respect to particular embodiments and with reference to certain drawings but the invention is not limited thereto. The drawings described are only schematic and are non-limiting. In the drawings, the size of some of the elements may be exaggerated and not drawn on scale for illustrative purposes.

It will be understood that the terms "vertical" and "horizontal" are used herein refer to particular orientations of the Figures and these terms are not limitations to the specific embodiments described herein.

As used herein, the terms "box" and "pin" refer to the type of connection provided on the turbine shaft and/or the bit shank, and the terms "connector" or "connection" are implied.

Each drill bit comprises a bit head and at least a bit gauge. Typically, each drill bit can be considered to comprise a bit head, a bit gauge and a bit shank. In addition, a drill bit may also comprise a bit sleeve. The bit gauge is typically formed over the bit shank, and if a bit sleeve is present, that is also formed over the bit shank. The bit head, bit gauge, and bit shank, together with the bit sleeve, if present, may be constructed individually or in combination with one another, and the present invention is not limited to drill bits having separate, individually constructed portions.

Figure 1:
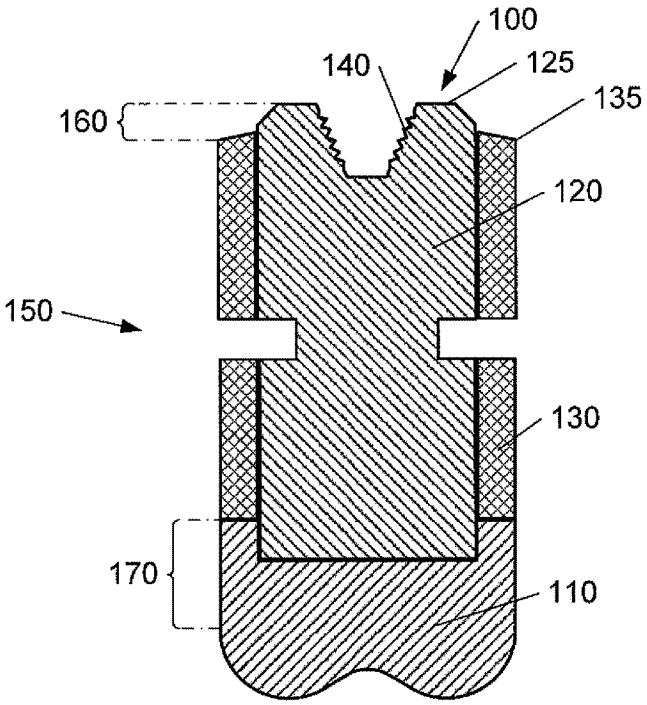
FIG. 1 illustrates a longitudinal cross-section through a conventional box connection drill bit with sleeve.

In FIG. 1, a longitudinal cross-section through a conventional "box" drill bit 100 is shown which comprises a bit head 110 mounted on a bit shank 120. A bit sleeve 130 surrounds the bit shank 120 between a bit gauge 170 and a shouldering surface 125 formed on the bit shank 120. A box connector 140 is provided in the bit shank 120 extending into the bit shank from the shouldering surface 125. As shown, a breaker-slot 150 is provided that extends through the bit sleeve 130 and into the bit shank 120. A length 160 is provided between an end 135 of the bit sleeve 130 and the shouldering surface 125 of the bit shank 120.

As the drill bit of FIG. 1 is a "box" bit, it tends to be relatively long so that the breaker-slot can be positioned as a suitable location along its length where it does not interfere with the box connector 140 or the bit head 110.

In a conventional tandem turbine-drill bit assembly (not shown) comprising the drill bit 100 of FIG. 1, the turbine shaft (also not shown) has a pin connector that engages with the box connector 140 of the drill bit 100. When assembled, a substantial gap, typically of between 125 mm and 250 mm (5" to 10"), is inadvertently provided between an end of the turbine stabiliser (not shown) and the end 135 of the bit sleeve 130.

FIG. 2 illustrates a longitudinal cross-section through a conventional "pin" drill bit 200 having a bit sleeve 230. The drill bit 200 comprises a bit head 210 and a bit gauge 270 mounted on a bit shank 220. In this case, the bit shank 220 is assembled to the bit head 210 and extends through the bit sleeve 230. The bit shank 220 has a pin connector 240 formed on a shouldering surface 225. The bit sleeve 230 has an end 235 which is located adjacent the pin connector 240 as shown. A breaker-slot 250 is positioned between the shouldering surface 225 (and pin connector 240) and the end 235 of the bit sleeve 230.

In this embodiment, the breaker-slot 250 is shown in the bit shank 220 only and not through the bit sleeve and the bit shank as shown in FIG. 1. It will be appreciated that the positioning of the breaker-slot 250 is limited in this case because of its location between the sleeve end 235 and the shouldering surface 225. The length 260 between the end of the bit sleeve 235 and the shouldering surface 225 is much larger than the length 160 between the shouldering surface 125 and the bit sleeve 135 as shown in FIG. 1.

Figure 3:
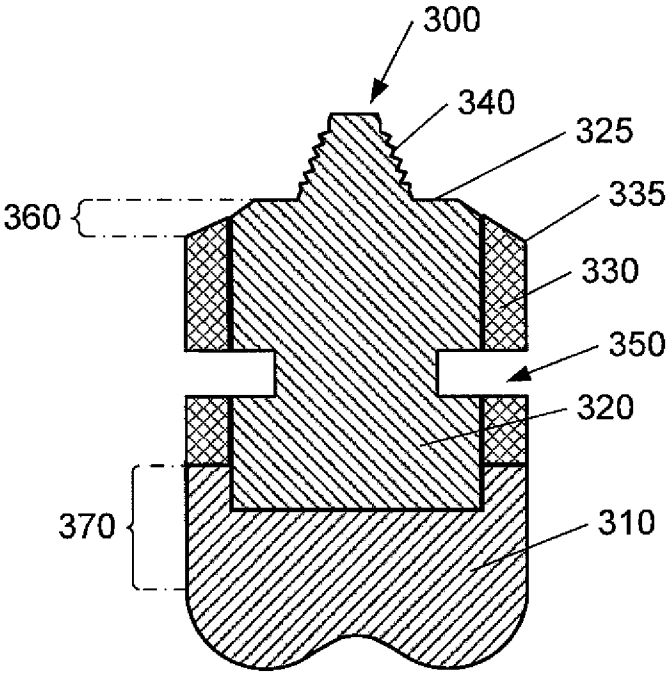
FIG. 3 illustrates a longitudinal cross-section through a pin connection drill bit with a bit sleeve in accordance with the present invention.

FIG. 3 illustrates a longitudinal cross-section through a "pin" drill bit 300 having a bit sleeve 330 that can be used in a turbine-drill bit assembly of the present invention. The drill bit 300 comprises a bit head 310, a bit gauge 370, a bit shank 320 and the bit sleeve 330. A pin connector 340 is formed on a shouldering surface 325 provided on the bit shank 320 as shown. As before, the bit sleeve 330 has an end 335 close to the shouldering surface 325 as indicated by length 360. A breaker-slot 350 is also provided in the drill bit 300 as shown and extends through the bit sleeve 330 and into the bit shank 320. The breaker-slot 350 is shown as being in a relatively central position with respect to the bit sleeve 330 of the drill bit 300 but can also be located at any suitable point along the bit sleeve 330.

Figure 4:
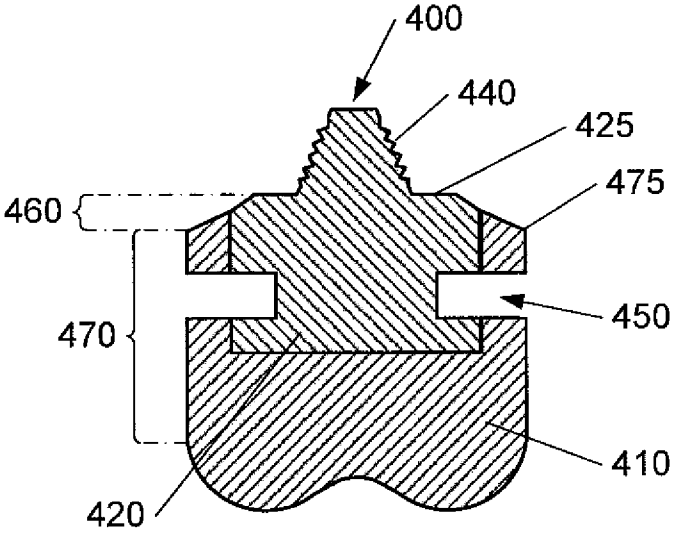
FIG. 4 illustrates a longitudinal cross-section through a pin connection drill bit without a bit sleeve in accordance with the present invention.

FIG. 4 illustrates a longitudinal cross-section through a "pin" drill bit 400 that can be used in a turbine-drill bit assembly of the present invention. The drill bit 400 is similar to drill bit 300 but without a bit sleeve, the drill bit being substantially shorter than the drill bit 300. The drill bit 400 comprises a bit head 410, a bit shank 420 and a bit gauge 470. A pin connector 440 is formed on a shouldering surface 425 provided on the bit shank 420 as shown. The bit gauge 470 has an end 475 close to the shouldering surface 425 as shown by gap 460. A breaker-slot 450 is also provided in the drill bit 400 as shown. Here, the bit gauge 470 is integrally formed with the bit head 410. As described above with reference to FIG. 3, the breaker-slot 450 can also be located at any suitable point along the bit gauge 470.

By having a "pin" drill bit including breaker slots in the bit sleeve or bit gauge as shown in FIGS. 3 and 4 respectively, the length 360 between the end 335 of the bit sleeve 330 (FIG. 3) and the end 475 of the bit gauge 470 (FIG. 4) and the respective shouldering surfaces 325, 425 is much shorter than length 260 shown on FIG. 2. Moreover, this shorter length 360, 460 allows a shorter assembly of the drill bit and the turbine. As a secondary advantage, the overall drill bit length can be substantially shorter than the drill bits shown in FIGS. 1 and 2 thereby decreasing its gauge and sleeve contact area with the wellbore wall during operation and distance from the bit head to the turbine.

However, as described above, when there is a substantial gap between the turbine stabiliser and the bit gauge end or bit sleeve end, excessive wear and erosion of the drill bit and turbine can be experienced. In accordance with the present invention, an assembly of a box connection turbine to a pin connection bit is provided which substantially reduces the gap between the end of the bit gauge or bit sleeve and the end of the turbine stabiliser as well as contributing to a shorter turbine-drill bit assembly to improve overall drilling performance. Such a turbine-drill bit assembly may comprise the drill bit 300 having a pin connection 340 shown in FIG. 3 or the drill bit 400 having a pin connection 440 shown in FIG. 4.

Figure 5:
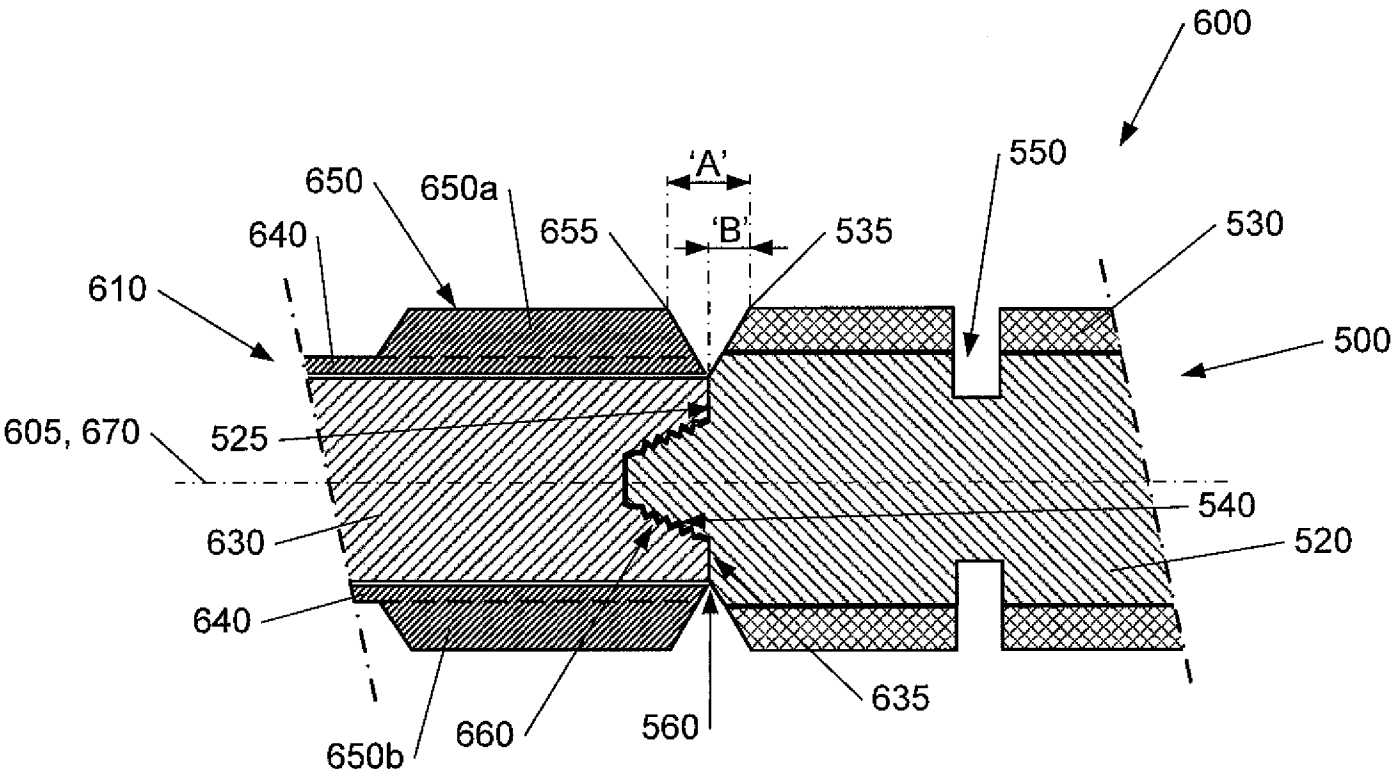
FIG. 5 illustrates a partial longitudinal cross-section through a tandem turbine-drill bit assembly in accordance with the present invention.

In FIG. 5, a partial longitudinal cross-section of a turbine-drill bit assembly 600 in accordance with the present invention is shown.

The assembly 600 comprises a "box" turbine 610 connected to a "pin" drill bit 500. The "pin" bit 500 may be similar or identical to the "pin" bit 300 shown in FIG. 3 or the "pin" bit shown in FIG. 4. The turbine 610 comprises a turbine shaft 630 and a turbine body 640 on which a turbine stabiliser 650 is formed, the turbine body 640 surrounding and being separated from the turbine shaft 630 as shown. The turbine body 640 is concentric with respect to the turbine shaft 630, as shown. The turbine stabiliser 650 may comprise several stabiliser blades 650*a*, 650*b* formed on the periphery of the turbine body 640 and is commonly referred to as a single component, namely, a turbine body stabiliser. In this Figure, the stabiliser blades 650*a*, 650*b* are formed so as to have an axis 670 which is concentric with respect to the turbine shaft axis 605. The turbine 610 also includes a box connector 660 as shown provided in the turbine shaft 630. The drill bit 500 comprises a bit head (not shown in FIG. 5), a bit shank 520 and a bit sleeve 530 as described above. A breaker-slot 550 is provided through the bit sleeve or bit gauge 530 and into the bit shank 520 to enable it to be attached to the turbine shaft 630. The drill bit 500 also includes a pin connector 540. The breaker-slot 550, as described above, is used with a bit breaker to attach the drill bit 500 to the turbine shaft 630 (and hence to the drill string (not shown) as described above), and also to detach the drill bit 500 from the turbine shaft 630. The attaching and detaching of the drill bit 500 with respect to the turbine shaft 630 (and hence to and from the drill string) is effectively achieved by screwing the drill bit 500 onto and off the turbine shaft 630. The bit breaker engages with the breaker-slot 550 so that it is possible to screw and unscrew the drill bit 500 with respect to the turbine shaft 430 so that respective box and pin connectors 660, 540 become fully engaged with one another using a suitable torque value so as not to damage the threaded connection so formed. Normally, the drill bit is held by the bit breaker and the turbine shaft is turned relative to the drill bit to allow the drill bit to be attached to, and detached from, the drill string.

Figure 6:
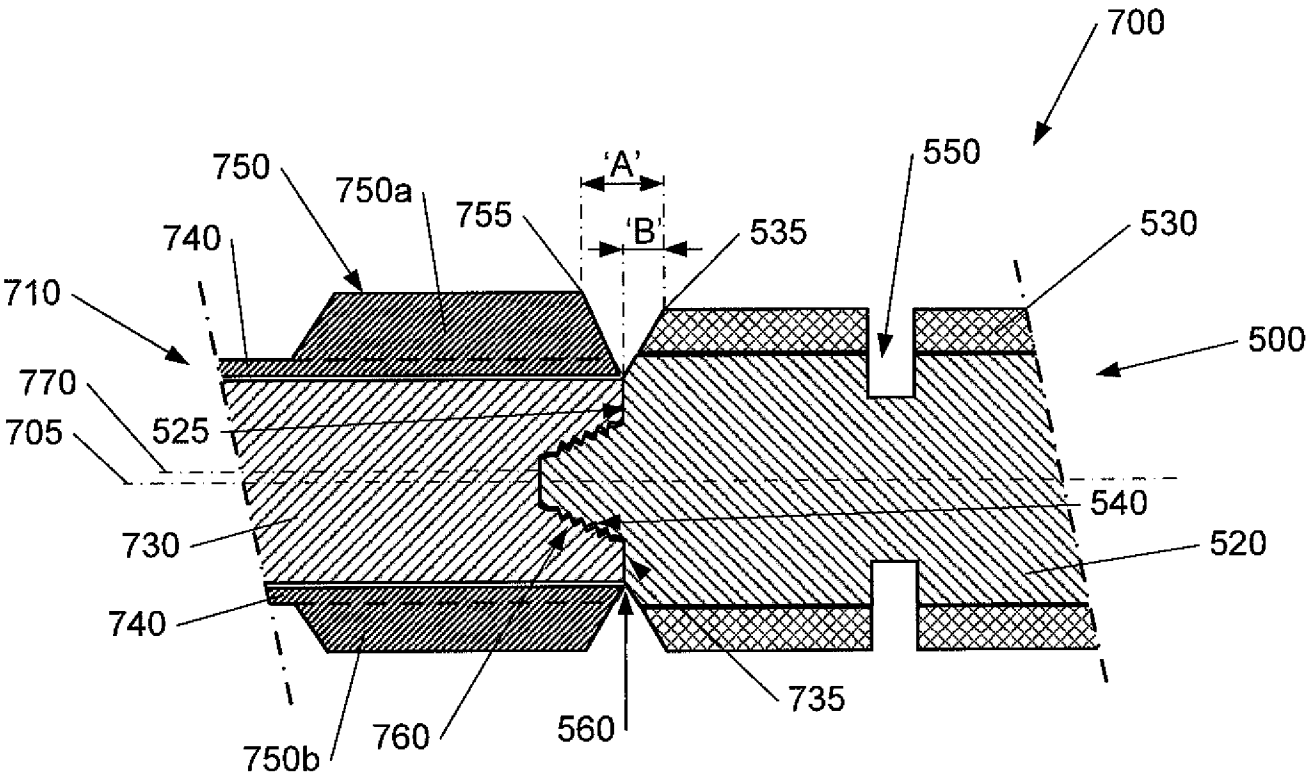
FIG. 6 is similar to FIG. 5 but for an eccentric turbine.

In FIG. 6, a partial longitudinal cross-section of a turbine-drill bit assembly 700 in accordance with the present invention is shown. The assembly 700 comprises a "box" turbine 710 connected to a "pin" drill bit 500. The "pin" bit 500 may be similar or identical to the "pin" bit 300 shown in FIG. 3 or the "pin" bit shown in FIG. 4. The turbine 710 comprises a turbine shaft 730 and a turbine body 740 on which a turbine stabiliser 750 is formed, the turbine body 740 surrounding and being separated from the turbine shaft 730 as shown. The turbine body 740 is concentric with respect to the turbine shaft 730, as shown. The turbine stabiliser 750 may comprise several stabiliser blades 750*a*, 750*b* formed on the periphery of the turbine body 740 and is commonly referred to as a single component, namely, a turbine body stabiliser. In this Figure, the stabiliser blades 750*a*, 750*b* are formed so as to have an axis (not shown) which is eccentric with respect to the turbine shaft 730 (also not shown). This is because the stabiliser blade 750*a* has a greater effective diameter than stabiliser blade 750*b* resulting in an effective rotational axis 770 of the turbine stabiliser 750 which describes a circle around the longitudinal axis 705 of the turbine shaft 730. The turbine 710 also includes a box connector 760 as shown provided in the turbine shaft 730.

The drill bit 500 is the same as that described with reference to FIG. 5 and will not be described again here.

As shown in FIG. 5, each turbine shaft 630 has an interface shouldering surface 635 which forms an abutting surface for an interface shouldering surface 525 formed on the bit shank 520. Similarly, the interface shouldering surface 525 forms an abutting surface for the interface shouldering surface 635, and together, the interface shouldering surfaces 635, 525 define a shouldering interface 560 between the bit shank 520 of the drill bit 500 and the turbine shaft 630 of the turbine 610.

Similarly for FIG. 6, each turbine shaft 730 has an interface shouldering surface 735 which forms an abutting surface for an interface shouldering surface 525 formed on the bit shank 520. Similarly, the interface shouldering surface 525 forms an abutting surface for the interface shouldering surface 735, and together, the interface shouldering surfaces 735, 525 define a shouldering interface 560 between the bit shank 520 of the drill bit 500 and the turbine shaft 730 of the turbine 710.

It has been found that, by reducing the distance between end 655 of the turbine body stabiliser 650 (FIG. 5) and end 535 of the bit sleeve or bit gauge 530, the overall performance of the turbine-drill bit assembly may substantially be improved by having the gap between end 655 of the turbine stabiliser body 650 and end 535 of the bit sleeve or bit gauge 530 to be at the most 50 mm (2") as indicated by distance 'A'. In addition, the distance between the shouldering interface 560 formed by the shouldering surfaces 635, 525 and end 535 of the bit sleeve or bit gauge 530 is at the most 37.5 mm (1.5") as indicated by distance 'B'.

Similarly, for the arrangement shown in FIG. 6, by reducing the distance between end 755 of the turbine body stabiliser 750 and end 535 of the bit sleeve or bit gauge 530, the overall performance of the turbine-drill bit assembly may substantially be improved by having the gap between end 755 of the turbine stabiliser body 750 and end 535 of the bit sleeve or bit gauge 530 to be at the most 50 mm (2") as indicated by distance 'A'. In addition, the distance between the shouldering interface 560 formed by the shouldering surfaces 735, 525 and end 535 of the bit sleeve or bit gauge 530 is at the most 37.5 mm (1.5") as indicated by distance 'B'.

Both distances 'A' and 'B' can be predetermined, but are related to particular drill bit designs, drill bit sizes and also turbine geometries. In particular, the bevel angle of the bit sleeve or bit gauge 530 at end 535 can be tuned to adjust the effective distances 'A' and 'B'.

It will be appreciated that, for some other turbine-drill bit assemblies, the predetermined distances 'A' and 'B' may have maximum values other than those given above. For example, the distance 'A' may be in a range of between 35 to 50 mm and the distance 'B' may be in a range between 15 to 37.5 mm.

The particular dimensions for the maximum distances 'A' and 'B' of 50 mm and 37.5 mm respectively provide unexpected advantages in that less wear and/or erosion is obtained at the turbine-bit interface. However, a more rigid tandem turbine-drill bit assembly is obtained, particularly, if the turbine comprises an eccentric turbine stabiliser (ETS). In addition, by moving the location of the breaker-slot from the bit shank to a position along the bit sleeve or bit gauge, a shorter drill bit can be used thereby providing higher stability, greater directional control, and lower contact area with the wellbore. The reduction of the total contact area with the wellbore lowers the resulting sticking forces between the turbine-drill bit assembly during the drilling operation. This reduces the risk of the bit getting stuck in the well, and, therefore, the chances of losing the assembly downhole.

In addition, overall performance of the turbine-drill bit assembly 600 (FIG. 5) and 700 (FIG. 6) can substantially be improved. For example, the rate of penetration during the drilling operation may be increased subject to the type of rock in which the drilling operation is carried out; drill bit and/or turbine life may also be increased as there is no formation of the mud and rock debris ring; and better stabilisation of the turbine-drill bit assembly can be obtained as well as better anti-sticking properties. Reduced wear and reduced shaft erosion can also be obtained.

For an ETS arrangement, the turbine is typically "box" and the bit used therewith is "pin". This arrangement allows shorter bits to be used, and, smaller spacing distances between the turbine stabiliser and the bit sleeve, as well as smaller spacing distances between the bit sleeve and the interface formed by the shouldering surfaces as described above.

The drill bit described above is an impregnated drill bit, but it will readily be understood that the present invention is not limited to impregnated drill bits, and polycrystalline diamond cutter (PDC) drill bits can also be used in a turbine-drill bit assembly according to the present invention.

The present invention is also not limited to use with ETS arrangements and can equally well be applied to turbine concentric stabilisers.

Although the present invention has been described with respect to specific embodiments, it will readily be understood that deviations can be made from these specific embodiments without departing from the scope of the present invention.

The invention claimed is:

1. A turbine-drill bit assembly comprising:
- a turbine comprising:
  - a turbine shaft;
  - a turbine interface shouldering surface formed on the turbine shaft;
  - a turbine body;
  - a turbine body stabilizer formed on the turbine body, an end of the turbine body stabilizer proximate to the turbine interface shouldering surface; and
- a drill bit comprising:
  - a bit head;
  - a bit gauge;
  - a bit shank; and
  - a bit interface shouldering surface formed on the bit shank and adjacent to the turbine interface shouldering surface, an end of the bit gauge proximate to the bit interface shouldering surface.

2. A turbine-drill bit assembly according to claim 1, wherein the drill bit includes a bit sleeve extending over the bit shank from the bit gauge, the turbine body stabilizer being spaced from an end of the bit sleeve by the first distance and the turbine interface shouldering surface is spaced from the end of the bit sleeve by the second distance.

3. A turbine-drill bit assembly according to claim 1, wherein the turbine comprises a concentric turbine body stabilizer in which the turbine body stabilizer has a rotation axis substantially aligned with an axis of the turbine shaft.

4. A turbine-drill bit assembly according to claim 1, wherein the turbine comprises an eccentric turbine body stabilizer in which the turbine body stabilizer has a rotation axis offset from an axis of the turbine shaft.

5. A turbine-drill bit assembly according to claim 1, wherein the turbine interface shouldering surface comprises a box connector on the turbine shaft connected to a pin connector on the bit shank.

6. A turbine-drill bit assembly according to claim 1, wherein the first distance is less than approximately 50 mm and the second distance is less than approximately 37.5 mm.

7. A turbine-drill bit assembly according to claim 1, wherein the bit shank includes a pin connector.

8. A turbine-drill bit assembly according to claim 7, further comprising a bit sleeve extending between the bit gauge and the pin connector.

9. A turbine-drill bit assembly according to claim 7, wherein the bit gauge is integrally formed with the bit head.

10. A turbine-drill bit assembly according to claim 1, wherein:
- the end of the turbine body stabilizer includes a beveled edge having a first slope; and
- the end of the bit gauge includes a beveled edge having a second slope, the first slope and the second slope configured to adjust the first distance and the second distance.

* * * * *